US007147178B2

(12) United States Patent
Kan

(10) Patent No.: US 7,147,178 B2
(45) Date of Patent: Dec. 12, 2006

(54) SEQUENTIALLY STRIPPING-OFF TYPE ADHESIVE TAPE SET

(76) Inventor: Shen-Nan Kan, 3 Fl., No. 12, Sec. 1, Jungshing Rd., Wugu Shiang, Taipei Hsien (TW)

( * ) Notice: Subject to any disclaimer, the term of this patent is extended or adjusted under 35 U.S.C. 154(b) by 304 days.

(21) Appl. No.: 10/852,177

(22) Filed: May 25, 2004

(65) Prior Publication Data

US 2005/0274841 A1 Dec. 15, 2005

(51) Int. Cl.
*B65H 16/00* (2006.01)

(52) U.S. Cl. ..... 242/588; 242/597.8; 242/598.3; 242/598.5; 428/343

(58) Field of Classification Search ..... 242/588, 242/597, 597.8, 598.3, 598.5, 614, 599.3; 428/343

See application file for complete search history.

(56) References Cited

U.S. PATENT DOCUMENTS 4,729,518 A * 3/1988 Mathna et al. ..... 242/422.4

* cited by examiner

*Primary Examiner*—John Q. Nguyen
(74) *Attorney, Agent, or Firm*—Troxell Law Office, PLLC

(57) ABSTRACT

A sequentially stripping-off type adhesive tape set comprising a sequentially stripping-off type adhesive tape in the form of a reel, a holding member and a seat; the adhesive tape has thereon many layers of adhesive tape pieces cut in strips wound on a hollow axle cylinder. When in cutting the layers of the adhesive tape, they are broken away at one side, and are left with short uncut connecting rims at the other side. When the sequentially stripping-off type adhesive tape is placed on the holding member, it needs only that the adhesive tape is rotated for a circle, the tearing areas on one side of the adhesive tape pieces can be brought out, then the user can tear the adhesive tape pieces in either of two ways until the whole roll of adhesive tape is all used.

9 Claims, 11 Drawing Sheets

SEQUENTIALLY STRIPPING-OFF TYPE ADHESIVE TAPE SET

BACKGROUND OF THE INVENTION

1. Field of the Invention

The present invention is related to a sequentially stripping-off type adhesive tape set, and especially to a sequentially stripping-off type adhesive tape of which one side is completely cut to separate, while the other side is left with short uncut connecting rims, the adhesive tape is in the form of a reel, every two neighboring adhesive tape pieces are thereby connected with each other without dropping A user can pick up stripping heads of a plurality of adhesive tape pieces to pull up tearing areas of the adhesive tape pieces of a top layer, and in turn to bring out to cock tearing areas of the adhesive tape pieces of a lower layer for convenient taking the adhesive tape pieces by tearing in either of two ways. The present invention suits the purposes of sticking, packaging, fixing or labeling in reading information.

2. Description of the Prior Art

The products of adhesive tapes have been popularized to become the necessities in our lives, and have been being used in the arts of ready-made clothes, general merchandises, and the fields of offices etc.; such as in a bakery, breads are packed with plastic bags, then the mouths of the plastic bags are turned over and are stuck with adhesive tapes. In a market, fruits and vegetables are stacked into cardboard boxes, and then the mouths of the cardboard boxes are fixed by sticking with adhesive tapes. In some cases, adhesive tapes are stuck on a wall or on a floor to mark out working areas or warning areas. Therefore, adhesive tapes are provided for the functions of sticking, packaging, fixing or marking. However, during the process of using, a user often is troubled by cutting the adhesive tapes and deciding the length of cutting, particularly a cutting action is required for every adhesive tape to be taken and a knife or a sharp tool is required for it, if it happens that there is no such an auxiliary tool, cutting of an adhesive tape becomes difficult, and if the adhesive tape is forced to tear up, the breaking area looks very ugly.

Although there have been reel type adhesive tapes which each is placed on the front end of an adhesive tape stand with a cutting device to make convenient of tearing by pulling at any time, the adhesive tape must be pull out and cut on the cutting device in order to take a section of adhesive tape, it is not easy to control the length of every section taken to be equal. Besides, the edges of the adhesive tape are still not adequately neat and in good appearance.

Further, we can see in the markets a kind of alternate type adhesive tape package from which when a user tears a first adhesive tape piece, a second adhesive tape piece therebeneath can be brought up by a sticking force to reveal an end with no adhesive of the second adhesive tape piece for the convenience of tearing by the user. However, the amount of the adhesive tape pieces in designing is not large, this is inconvenient and uneconomic for those shops needing many adhesive tape pieces.

Another kind of conventional adhesive tape set has a prying means and a pressing ring to pick up an adhesive tape piece by rotating the adhesive tape set, so that the user can take the adhesive tape piece. This can solve the problem resided in the former type of adhesive tape package, however, the structure of it is not mature enough, every time when it is to use an adhesive tape piece, the prying means must be pressed to pick up the adhesive tape piece, and the adhesive tape piece can only be torn in the one-way mode, this is cumbersome in operation.

In view of these, the inventor provided the present invention after hard study and development.

SUMMARY OF THE INVENTION

The primary object of the present invention is to provide a sequentially stripping-off type adhesive tape set which is in the form of a reel, a user can take the adhesive tape pieces by tearing in a two-way mode after he pries a whole circle of one side of the first layer of adhesive tape pieces, this can avoid the bother of prying the adhesive tape pieces one by one.

The secondary object of the present invention is to provide a divertible seat for the sequentially stripping-off type adhesive tape set in order that the adhesive tape pieces can be more conveniently torn and used.

To achieve the above object, a sequentially stripping-off type adhesive tape set of the present invention is designed to have a sequentially stripping-off type adhesive tape, a holding member and a seat, wherein the seat is mounted thereon with the holding member, while the holding member is provided for placing thereon the sequentially stripping-off type adhesive tape in the form of a reel; the sequentially stripping-off type adhesive tape has thereon many layers of adhesive tape pieces cut in strips wound on a hollow axle cylinder. The front end or the rear end on the bottom surface of each of the adhesive tape pieces is not added with adhesive in order to be used as a tearing area, and the rest portion of it is added with adhesive for sticking to a corresponding one of the adhesive tape pieces of the lower layer, the tearing areas of the mutual neighboring upper and lower layers having no adhesive are arranged alternately in the front-rear direction.

When the adhesive tape is placed in the holding member, a short uncut connecting rim between every two neighboring adhesive tape pieces connects the two without dropping, a tongue of a prying means is used to pry, so that the short connecting rim is broken away to cock the tearing area of an adhesive tape piece, and the user can pull up the tearing area of the adhesive tape piece of the top layer, while the tearing area of an adhesive tape piece of the lower layer is brought out to cock to lap over a protruding annular edge of the holding member, this makes convenient of taking the whole reel of the adhesive tape pieces by tearing in either of two ways.

The present invention will be apparent after reading the detailed description of the preferred embodiment thereof in reference to the accompanying drawings.

DETAILED DESCRIPTION OF THE PREFERRED EMBODIMENT

Figure 1A:
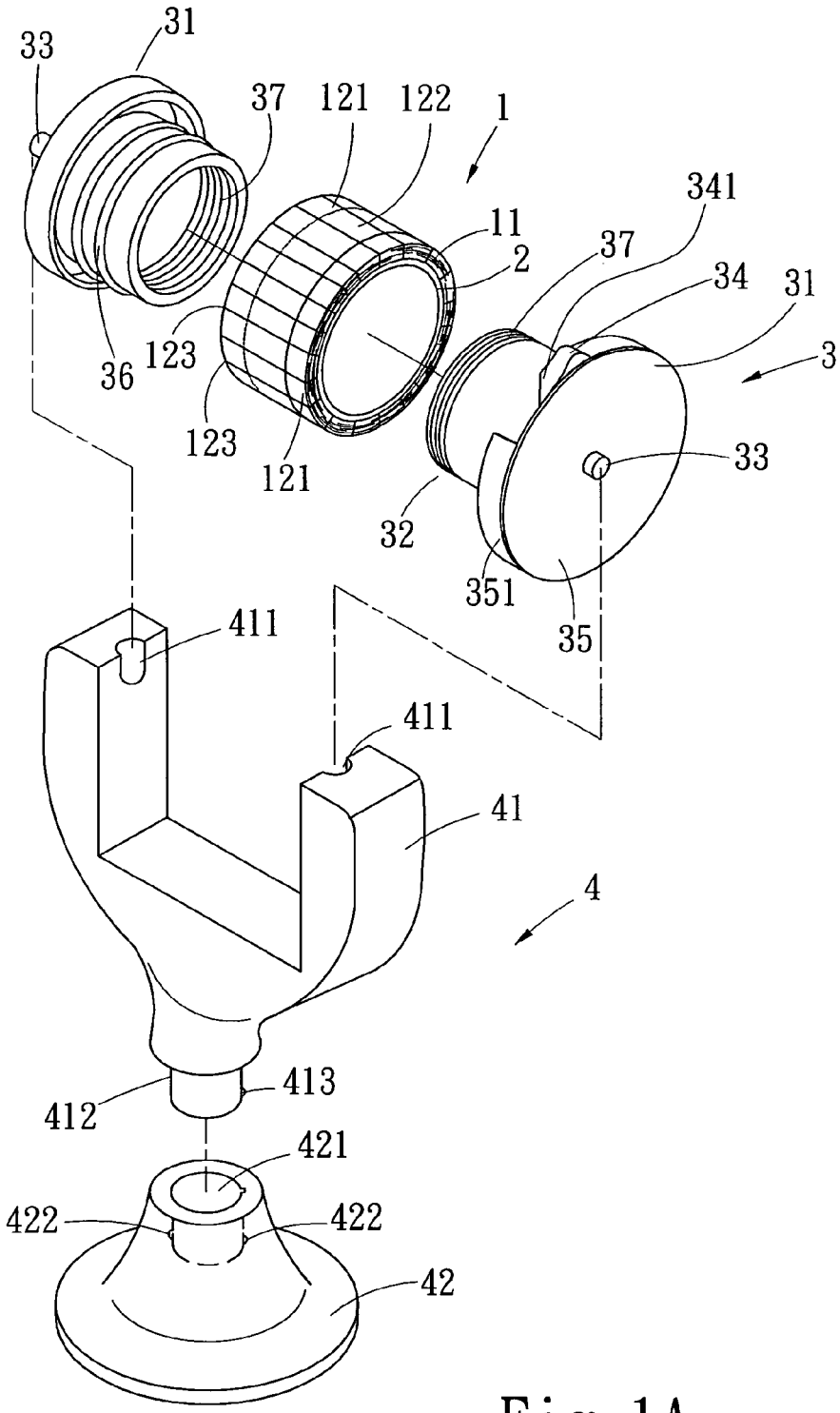
FIG. 1A is an exploded perspective view showing the elements of an embodiment of the present invention.
Figure 1B:
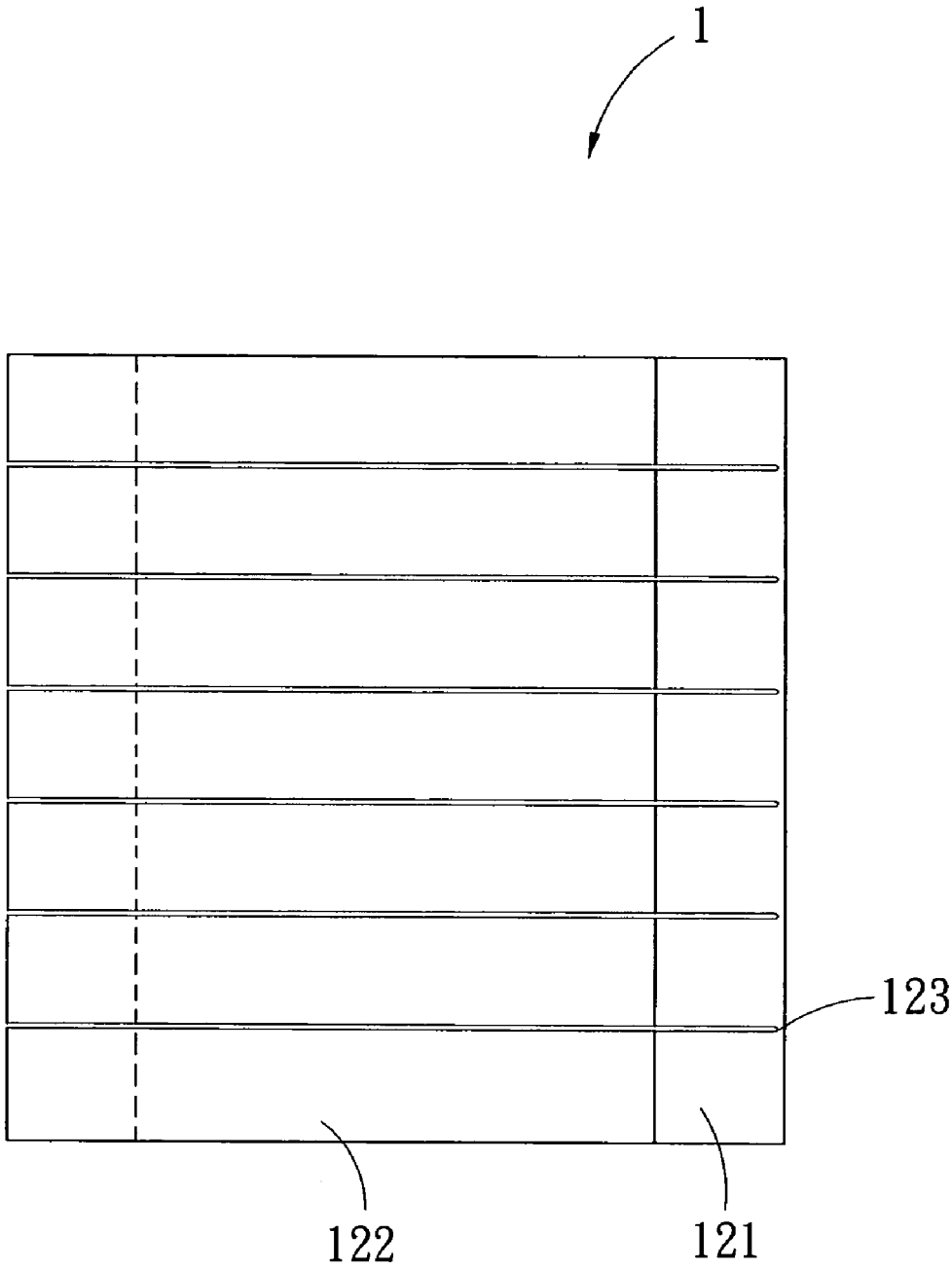
FIG. 1B is a front schematic view showing the sequentially stripping-off type adhesive tape of the embodiment of the present invention.
Figure 2:
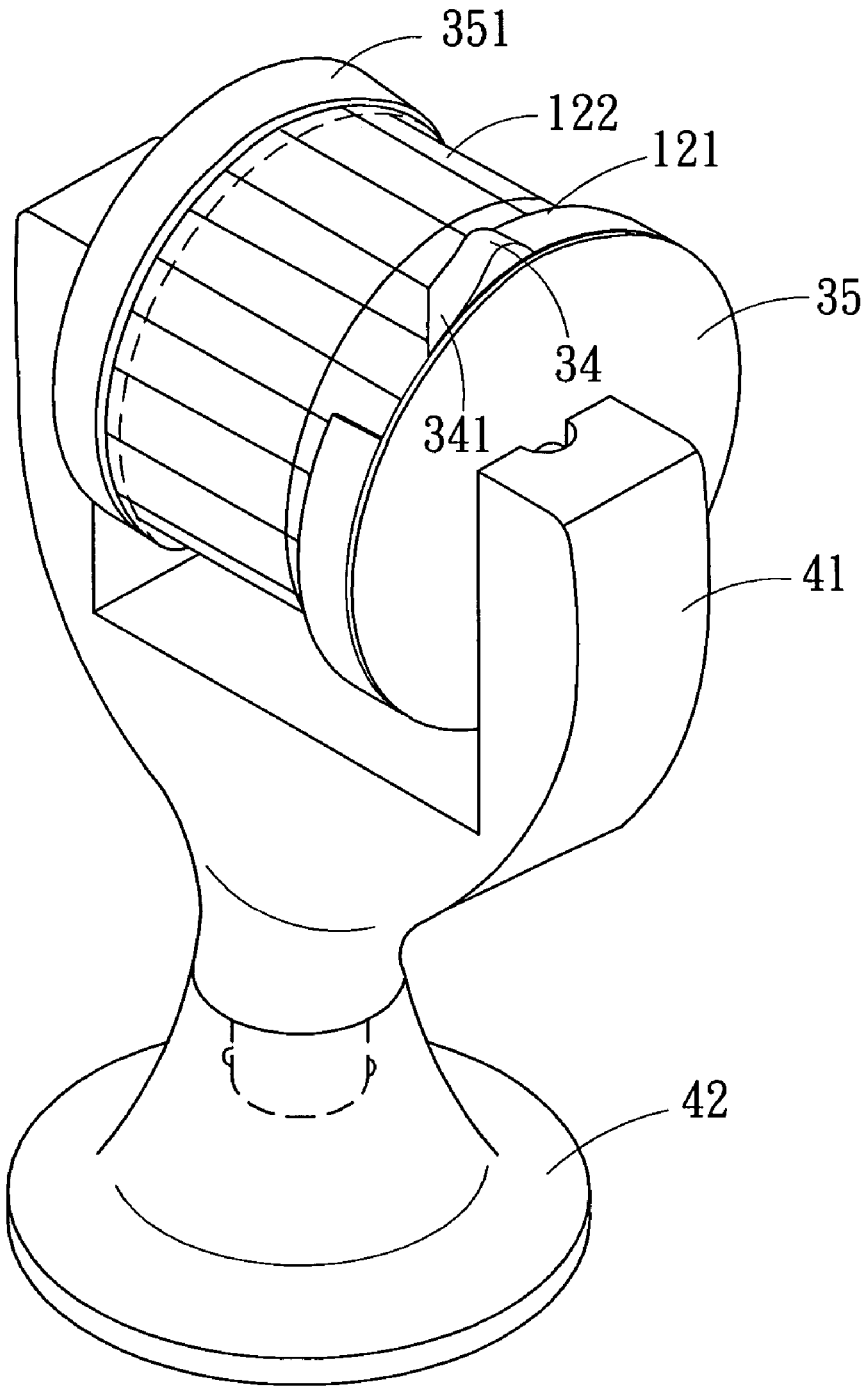
FIG. 2 is a perspective view showing assembling of the embodiment of the present invention.
Figure 3:
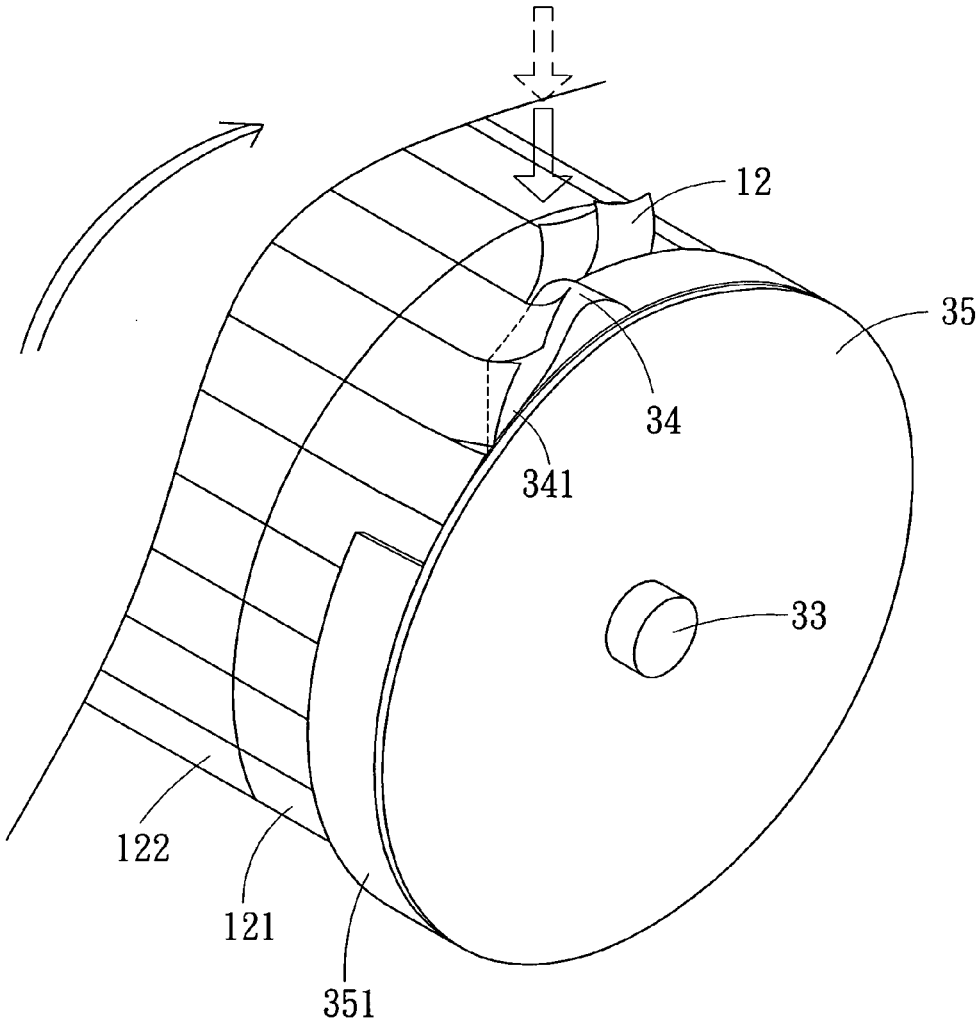
FIG. 3 is a perspective schematic view showing placing of a sequentially stripping-off type adhesive tape of the embodiment of the present invention on a holding member and prying of tearing areas of adhesive tape pieces.

Referring firstly to FIGS. 1A, 1B and 2 showing an embodiment of a sequentially stripping-off type adhesive tape set of the present invention; the tape set comprises a sequentially stripping-off type adhesive tape 1, a holding member 3 and a seat 4. As shown in FIG. 3, wherein a plurality of overlapping layers 11 of the sequentially stripping-off type adhesive tape 1 are arranged to be mutually juxtaposed and to circle an axle cylinder 2 to form the sequentially stripping-off type adhesive tape 1 in the form of a reel. The overlapping layers 11 of the sequentially stripping-off type adhesive tape 1 are formed by mutual overlapping of adhesive tape pieces 12 cut in strips, the front end or the rear end on the bottom surface of each of the adhesive tape pieces 12 is not added with adhesive in order to be used as a tearing area 121, and the rest portion of it is a sticking area 122 which is added with adhesive for sticking to a corresponding one of the adhesive tape pieces 12 of a lower layer. The tearing areas 121 of the mutual neighboring upper and lower layers having no adhesive are arranged alternately in the front-rear direction. When a user pulls up the tearing areas 121 of the adhesive tape pieces 12 of the top layer, the tearing areas 121 on the other ends of the adhesive tape pieces 12 of the lower layer are brought out to cock, the user can then take the adhesive tape pieces 12 by tearing in either of two ways.

Moreover, when in cutting the overlapping layers 11 of the sequentially stripping-off type adhesive tape 1, they are broken away at one side, and are left with short uncut connecting rims 123 at the other side. The short uncut connecting rims 123 each has a width of 1 mm, every two neighboring adhesive tape pieces 12 are thereby connected with each other without dropping by having such a short uncut connecting rim 123.

The holding member 3 is an "I" shaped member capable of being detached and assembled, the holding member 3 is formed by connecting of two "T" shaped parts 31 with screw threads 37 respectively on their mutual confronting ends, and a middle cylindrical shank 32 located centrally of the holding member 3 is formed to bear thereon the axle cylinder 2. The middle cylindrical shank 32 is provided thereon with a plurality of mutually spaced protruding annular ribs 36 to reduce the friction against the sequentially stripping-off type adhesive tape 1 when the latter is rotated on the middle cylindrical shank 32 of the holding member 3. The middle cylindrical shank 32 is provided on the outer ends thereof with enlarged end lids 35 to partially hug the two ends of the sequentially stripping-off type adhesive tape 1, and the end lids 35 are provided on the outer sides thereof with two central protruding axles 33.

Figure 4:
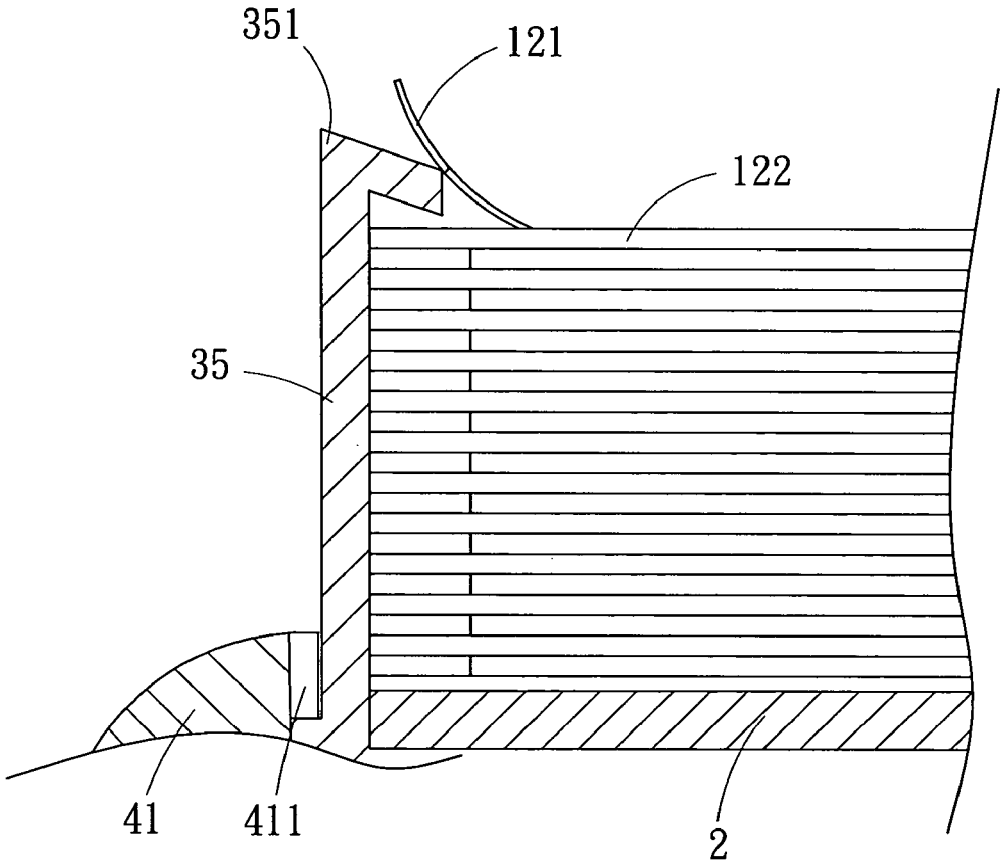
FIG. 4 is a sectional view showing a tearing area of an adhesive tape piece of the embodiment of the present invention is lapped over a protruding annular edge of an end lid.
Figure 6:
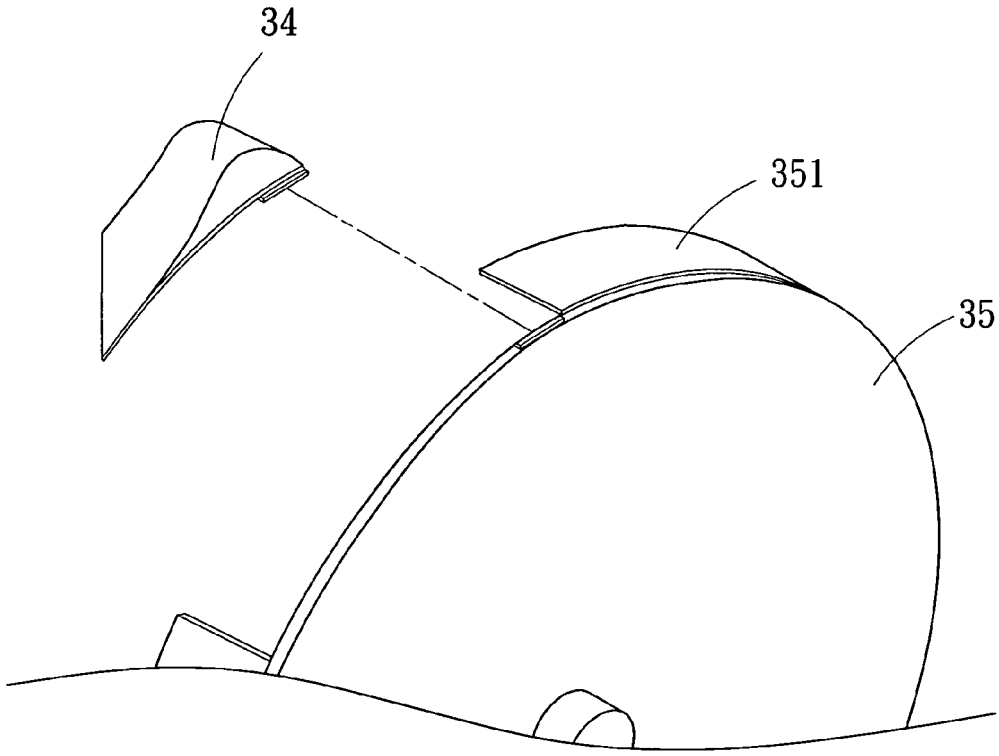
FIG. 6 is a perspective schematic view showing an adhesive tape-piece prying means of the embodiment of the present invention.

As shown in FIGS. 4 and 6, the end lids 35 of the holding member 3 each has a protruding annular edge 351 inclined inwardly for a small angle, one of the protruding annular edges 351 is provided with a raised prying means 34 which can be elastically pressed, the prying means 34 has thereon a tilting tongue 341 for prying tearing areas 121 of the adhesive tape pieces 12.

Figure 5:
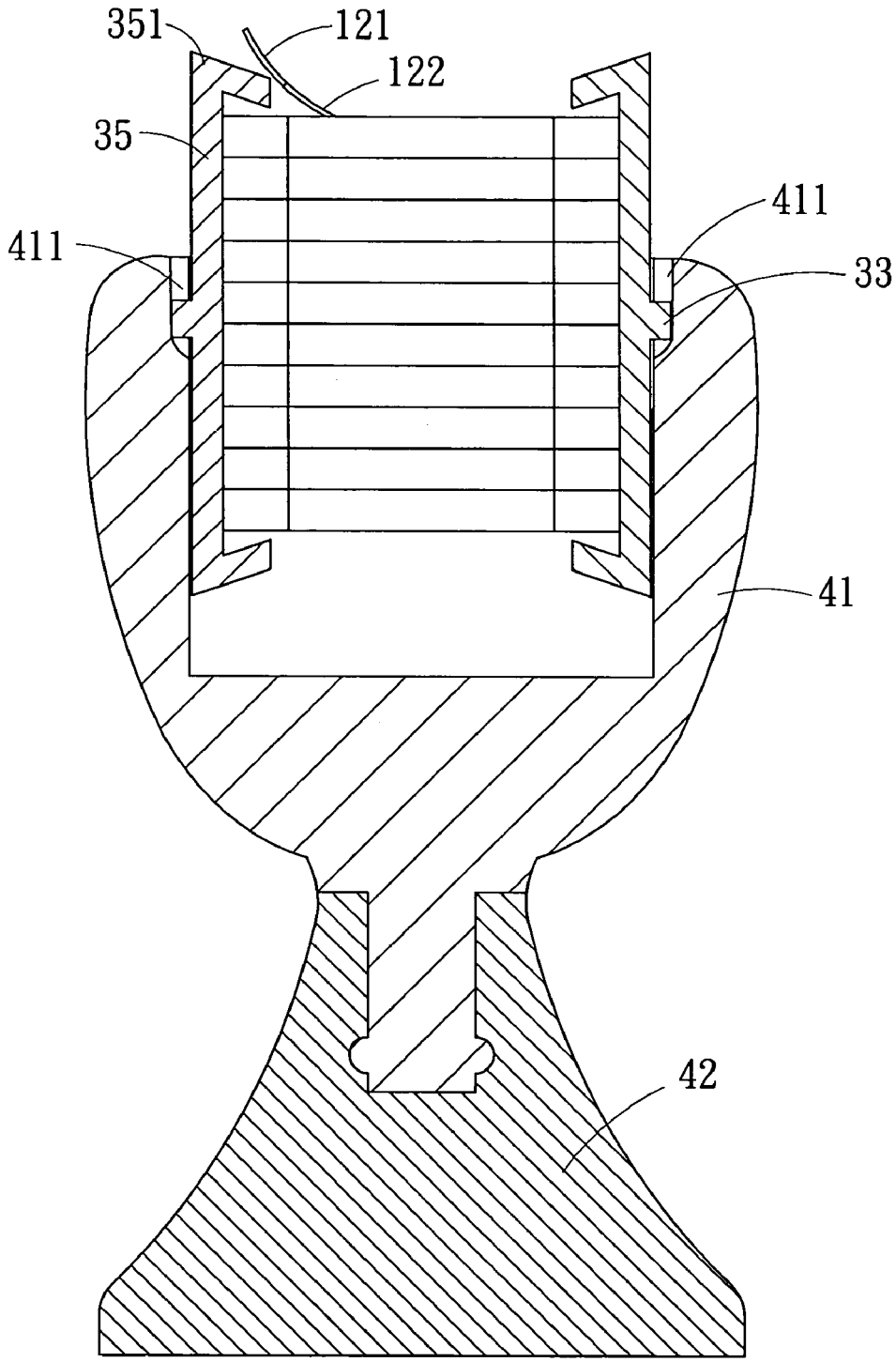
FIG. 5 is a sectional view showing that two central protruding axles of the holding member is supported on a pair of exposed recesses on arms of a seat of the embodiment of the present invention.

The seat 4 has thereon two arms 41 which include two exposed recesses 411 respectively to allow the two central protruding axles 33 of the holding member 3 to be supported on the two exposed recesses 411 as is shown in FIG. 5.

When in application, the sequentially stripping-off type adhesive tape 1 is placed on the holding member 3. It needs only that the adhesive tape 1 is rotated at the first time of use, and meantime a elastic prying means 34 which is slightly raised from the corresponding protruding annular edge 351 is pressed, the tilting tongue 341 of the prying means 34 pries all the tearing areas 121 on one side of the adhesive tape pieces 12 in the first layer of the adhesive tape 1 and has them lapped over the protruding annular edge 351 of the corresponding end lid 35, then the prying means 34 can be released from the adhesive tape 1. It needs only that the tearing areas 121 in the adhesive tape pieces 12 of the first layer are pulled up, then the tearing areas 121 in the adhesive tape pieces 12 of the lower layer can be brought out to cock, and a user can then tear the adhesive tape pieces 12 in either of two ways until the whole roll of adhesive tape 1 is all used.

And more, the seat 4 can have a rotation mechanism, the rotation mechanism includes a protruding post 412 provided beneath the two arms 41 and a base 42 having a socket 421, wherein the inner sidewall of the socket 421 is provided at two mutual opposite positions in a horizontal plane with two dents 422. One side of the protruding post 412 is provided with a protrusion 413, by rotation of the protruding post 412 placed in the socket 421 of the base 42, the protrusion 413 can exactly be engaged in one of the two dents 422 on the inner sidewall of the socket 421. If the protruding post 412 is rotated for 180 degrees, the protrusion 413 will be engaged in the other one of the two dents 422, in this way, the user can adjust the direction at will in operation for the convenience of taking the adhesive tape pieces 12.

Figure 7:
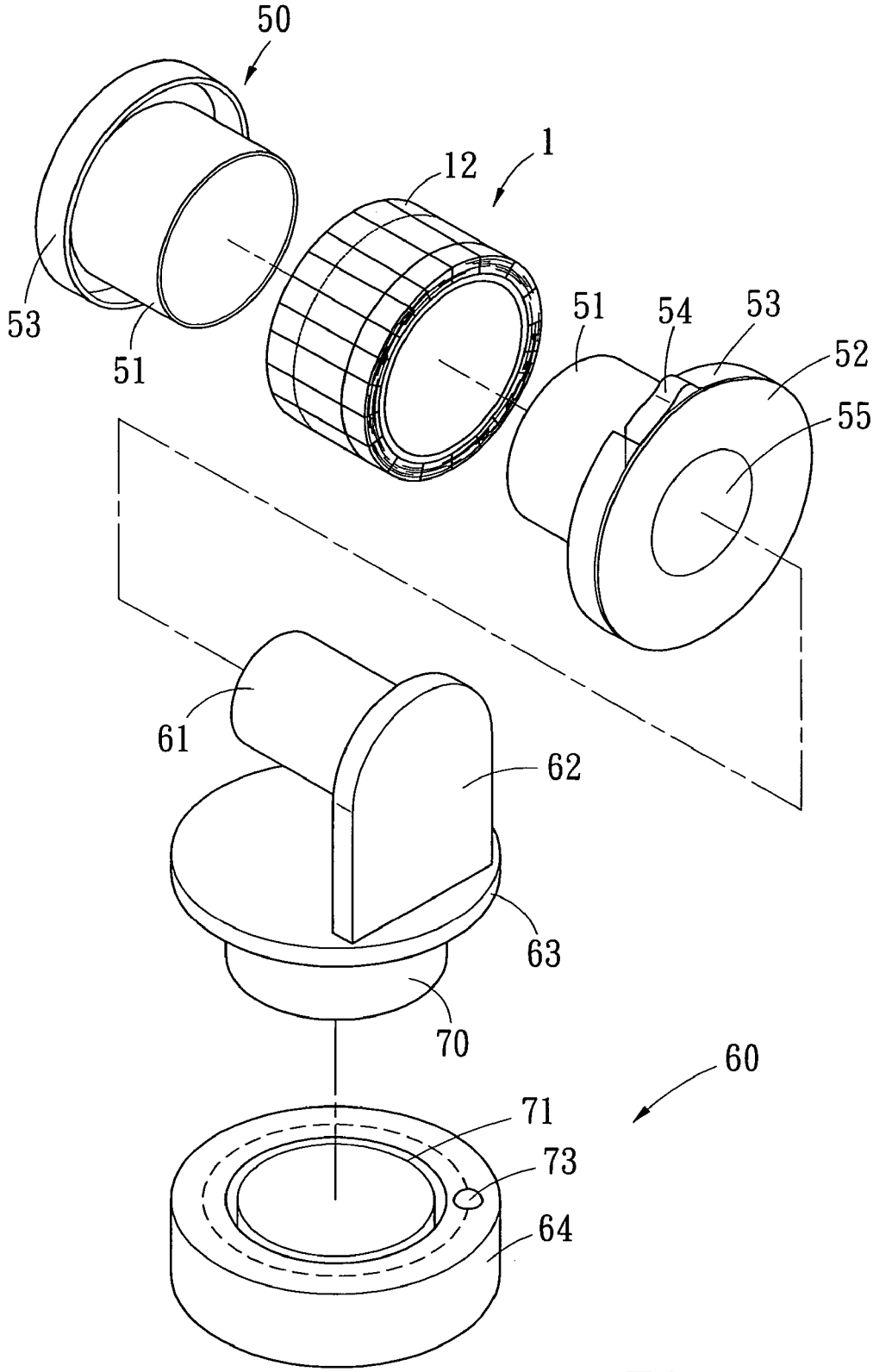
FIG. 7 is an exploded perspective view showing the elements of another embodiment of the present invention.
Figure 8:
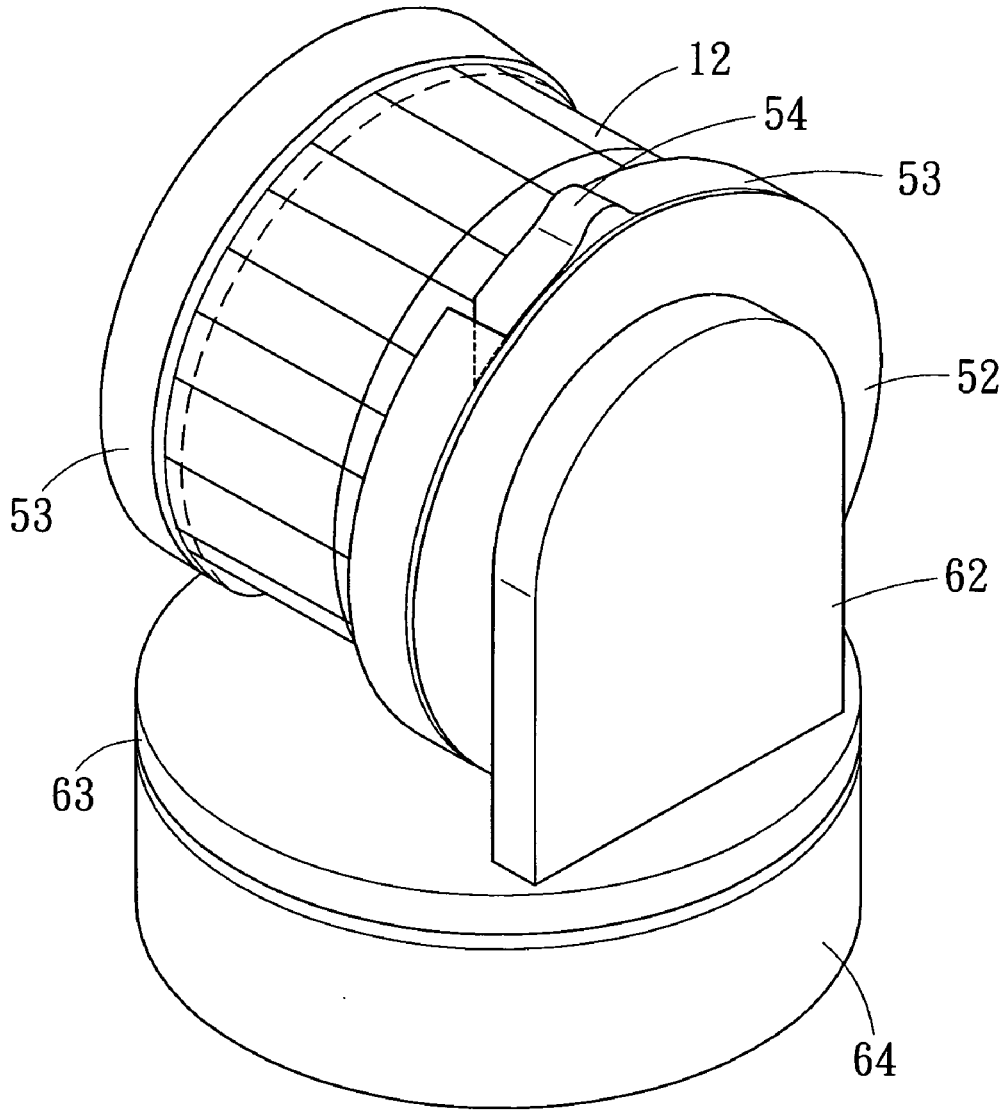
FIG. 8 is a perspective view showing assembling of the aforesaid another embodiment of the present invention.

Another embodiment of the present invention is shown in FIGS. 7 and 8, wherein the sequentially stripping-off type adhesive tape set comprises a sequentially stripping-off type adhesive tape 1, a holding member 50 and a seat 60; the structure of the sequentially stripping-off type adhesive tape 1 is same as that of the former embodiment, the holding member 50 is an "I" shaped member capable of being detached and assembled, and a middle cylindrical shank 51 of the holding member 50 is formed to bear thereon the sequentially stripping-off type adhesive tape 1, the middle cylindrical shank 51 is provided on the outer ends thereof with enlarged end lids 52 to partially hug the two ends of the sequentially stripping-off type adhesive tape 1, and one end lid 52 of the holding member 50 is provided with a protruding annular edge 53 and a prying means 54 both are same in function as those of the former embodiment, and are used to insert and pry the adhesive tape pieces 12 of the sequentially stripping-off type adhesive tape 1. An axle hole 55 is provided in one end lid 52, the other end lid 52 is solid.

Figure 9:
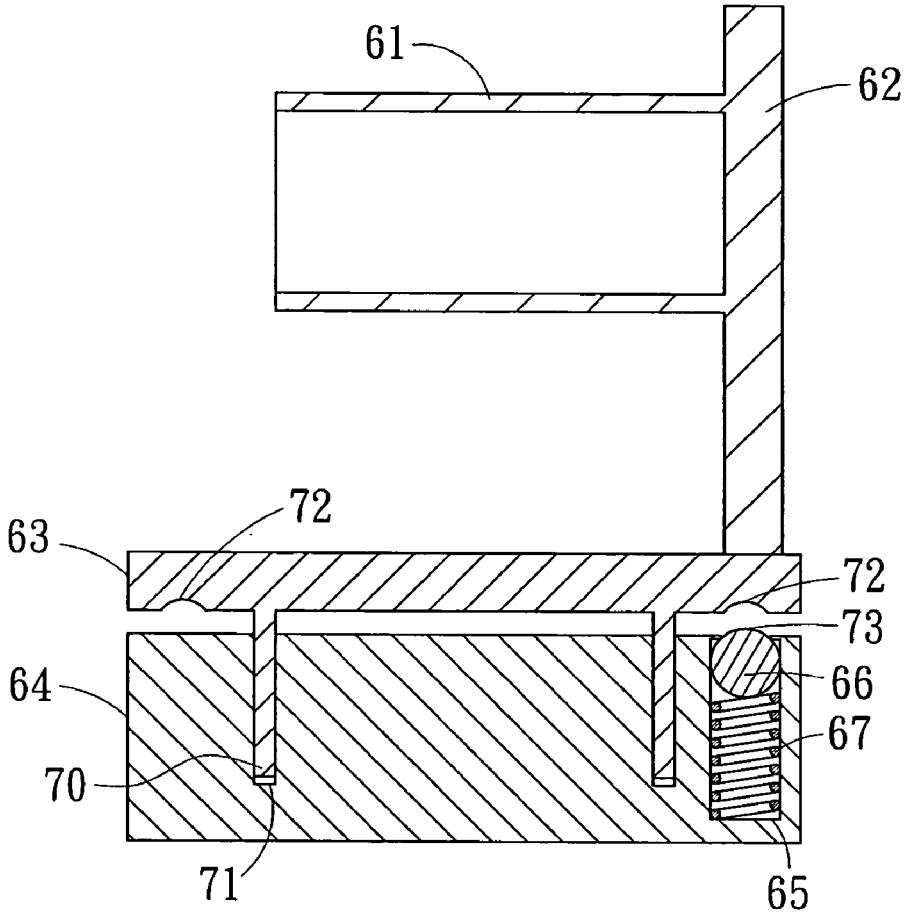
FIG. 9 is a sectional view showing a seat of the embodiment of the present invention.
Figure 10:
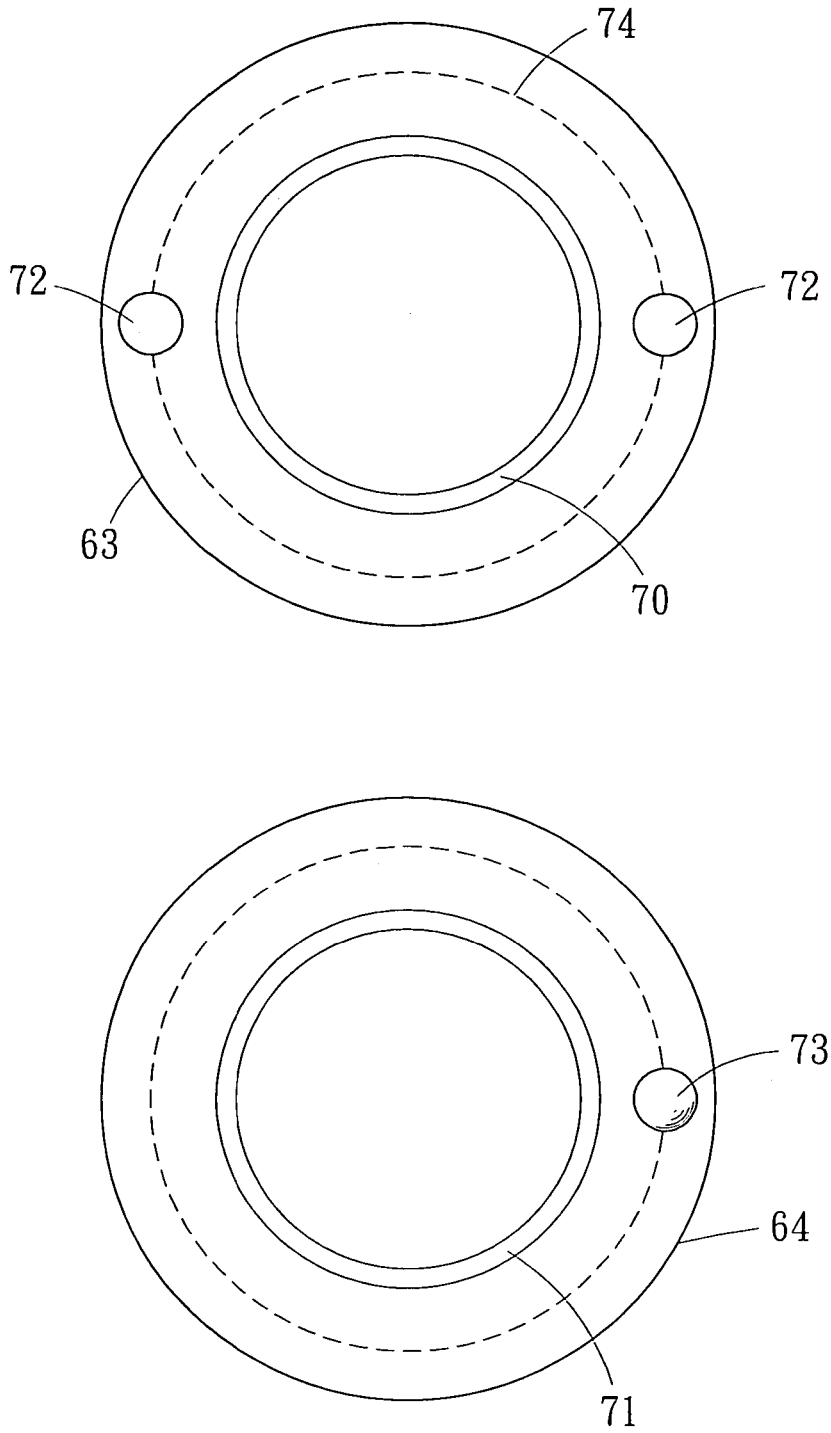
FIG. 10 shows front views of a bottom surface of an upper disk-like plate and a top surface of a lower disk-like plate respectively.

Referring to FIGS. 9 and 10, a seat 60 is formed to have a single arm, it comprises a supporting axle 61, a supporting arm 62, an upper disk-like plate 63 and a lower disk-like plate 64, wherein the supporting axle 61 is matched with the axle hole 55 on the holding member 50, so that when the supporting axle 61 is inserted into the axle hole 55, the holding member 50 can rotate about the supporting One end of the supporting axle 61 is connected with the supporting arm 62 vertically, and the bottom of the supporting arm 62 is fixed onto the upper disk-like plate 63.

The upper disk-like plate 63 and the lower disk-like plate 64 are round disks able to be separated and assembled, a rotation mechanism is provided for these two disks, so that the upper disk-like plate 63 and the lower disk-like plate 64 can be rotated relatively to each other. An embodiment of the rotation mechanism includes an annular rail 70, an annular groove 71, two dents 72 and a protrusion 73; wherein after assembling of the annular rail 70 provided on the upper disk-like plate 63 with the annular groove 71 on the lower disk-like plate 64, the upper disk-like plate 63 and the lower disk-like plate 64 are limited in position and can be rotated relatively to each other. The two dents 72 provided on the upper disk-like plate 63 are respectively provided at two ends of a diameter of a circle 74 which is concentric with the annular rail 70. When the upper disk-like plate 63 is assembled with the lower disk-like plate 64, the protrusion 73 of the lower disk-like plate 64 at a position on the circle 74 can be elastically pressed, and the lower disk-like plate 64 is provided with a recess 65. The notch of the recess 65 has a diameter smaller than that of a round ball 66, the bottom of the round ball 66 is supported by a spring 67, thereby a part of the round ball 66 is exposed out of the surface of the lower disk-like plate 64 and can be elastically pressed. Thereby, when the upper and the lower disk-like plates 63, 64 are assembled with each other and rotated relatively to each other, and when the protrusion 73 arrives at the position of one of the two dents 72, the protrusion 73 and the dent 72 engage with each other, then a force is exerted to rotate the upper disk-like plate 63 to render the protrusion 73 to move downwardly against the elastic force to get rid of the dent 72. After rotating for 180 degrees, the protrusion 73 arrives at the position of the other of the two dents 72 to engage therewith. Thereby, the user can adjust the direction at will in operation for the convenience of taking the adhesive tape pieces 12.

Although this invention has been disclosed and illustrated with reference to particular embodiments, however, the embodiments are not for giving any limitation to the scope of the present invention. It will be apparent to those skilled in this art that various equivalent modifications or changes made to the elements of the present invention without departing from the spirit and scope of this invention also fall within the scope of the appended claims and are intended to form part of this invention.

The present invention thereby has the following advantages:

1. The adhesive tape pieces of the sequentially stripping-off type adhesive tape in the form of a reel of the present invention are characterized by having a large amount and tidiness by size, they can take the place of the conventional adhesive tapes which are cut one by one, uneven in length and cumbersome in use, moreover, the tearing areas of the adhesive tape pieces of the present invention can be printed with colors, then they can show the user the positions of the stripping heads of the adhesive tape pieces, thereby it provides the function of color management and marking management.
2. By rotating the sequentially stripping-off type adhesive tape for a circle, the tearing areas on one side of the adhesive tape pieces can be brought out to cock, then the user can tear the adhesive tape pieces in either of two ways until the whole roll of adhesive tape is all used. The user no more needs to press the prying means, nor needs to find the stripping heads and cut the adhesive tape very hard; the present invention thereby is convenient and practicable.
3. The seat of the present invention is designed to be able to rotate for 180 degrees. The user can adjust the direction at will in operation for the convenience of taking the adhesive tape pieces.

In conclusion, the present invention surely can get the expected objects thereof to provide a sequentially stripping-off type adhesive tape set, it is structurally simple, convenient for use and has a good appearance; what I claim as new, industrially valuable and desire to be secured by Letters Patent of the United States are:

The invention claimed is:

1. A sequentially stripping-off type adhesive tape set comprising a sequentially stripping-off type adhesive tape in the form of a reel, a holding member and a seat, wherein said seat is mounted thereon with said holding member, said holding member is provided for placing thereon said sequentially stripping-off type adhesive tape in the form of a reel; said tape set being characterized in that:

said sequentially stripping-off type adhesive tape has thereon a plurality of layers of adhesive tape pieces cut in strips wound on a hollow axle cylinder; a front end or a rear end on the bottom surface of each of said adhesive tape pieces is not added with adhesive in order to be used as a tearing area, and the rest portion on the bottom surface is added with adhesive for sticking to a corresponding one of said adhesive tape pieces of a lower layer, said tearing areas of mutual neighboring upper and lower layers having no adhesive are arranged alternately in a front-rear direction; when a user pulls up said tearing areas of said adhesive tape pieces of a top layer, said tearing areas on the other ends of said adhesive tape pieces of said lower layer are brought out to cock; when in cutting said sequentially stripping-off type adhesive tape, said adhesive tape pieces are broken away at one side, and are left with short uncut connecting rims at the other side, every two neighboring ones of said adhesive tape pieces are thereby connected with each other without dropping; when said sequentially stripping-off type adhesive tape is placed on said holding member and rotated for a circle, and meantime a prying means is pressed, said tearing areas on one side of said adhesive tape pieces are pried, and said user then tears said adhesive tape pieces in either of two ways until a whole roll of said adhesive tape is all used.

2. The sequentially stripping-off type adhesive tape set as in claim 1, wherein said holding member is an "I" shaped member adapted to being detached and assembled, and a middle cylindrical shank located centrally of said holding member is formed, said middle cylindrical shank is provided on two outer ends thereof with enlarged end lids to partially hug two ends of said sequentially stripping-off type adhesive tape, and said end lids are provided on two outer sides thereof with two central protruding axles.

3. The sequentially stripping-off type adhesive tape set as in claim 2, wherein said holding member is formed by connecting of two "T" shaped parts with screw threads respectively on their mutual confronting ends, one of said "T" shaped parts is provided thereon with a plurality of mutually spaced protruding annular ribs to reduce friction against said sequentially stripping-off type adhesive tape when the latter is rotated on said middle cylindrical shank of said holding member; said end lids on the other of said "T"

shaped parts is provided with said prying means which is adapted for being elastically pressed, said prying means has thereon a tilting tongue for prying tearing areas of said adhesive tape pieces.

4. The sequentially stripping-off type adhesive tape set as in claim 3, wherein said end lids on said holding member each has a protruding annular edge inclined inwardly for a small angle to support said tearing areas of said adhesive tape pieces.

5. The sequentially stripping-off type adhesive tape set as in claim 2, wherein said seat has thereon two arms which include two exposed recesses respectively to allow said two central protruding axles of said holding member to be supported on said two exposed recesses.

6. The sequentially stripping-off type adhesive tape set as in claim 5, wherein said seat has a rotation mechanism, said rotation mechanism includes a protruding post provided beneath said two arms and a base having a socket, wherein an inner sidewall of said socket is provided at two mutual opposite positions in a horizontal plane with two dents; one side of said protruding post is provided with a protrusion, by rotation of said protruding post placed in said socket of said base, said protrusion is exactly engaged in one of said two dents on said inner sidewall of the socket; when said protruding post is rotated for 180 degrees, said protrusion is engaged in the other one of said two dents.

7. The sequentially stripping-off type adhesive tape set as in claim 1, wherein said short uncut connecting rims between every two neighboring ones of said adhesive tape pieces each has a width of 1 mm.

8. The sequentially stripping-off type adhesive tape set as in claim 1, wherein said holding member is an "I" shaped member adapted to being detached and assembled, and is provided on two outer ends thereof with enlarged end lids, and one of said end lids is solid, the other of said end lids is provided with an axle hole; said seat is formed to have a single arm, it comprises a supporting axle, a supporting arm, an upper disk-like plate and a lower disk-like plate, wherein said supporting axle is matched with said axle hole on said holding member, so that when said supporting axle is inserted into said axle hole, said holding member is adapted to rotate about said supporting axle; one end of said supporting axle is connected with said supporting arm vertically, the bottom of said supporting arm is fixed onto said upper disk-like plate; said upper disk-like plate is arranged above said lower disk-like plate, said upper and lower disk-like plates are round disks adapted to being separated and assembled.

9. The sequentially stripping-off type adhesive tape set as in claims 8, wherein said seat is provided with a rotation mechanism, said rotation mechanism includes an annular rail, an annular groove, two dents and a protrusion; wherein after matchably connecting of said annular rail provided on said upper disk-like plate with said annular groove on said lower disk-like plate, said upper disk-like plate and said lower disk-like plate are limited in position and adapted for rotating relatively to each other; said two dents provided on said upper disk-like plate are respectively provided at two ends of a diameter of a circle which is concentric with said annular rail; when said upper disk-like plate is assembled with said lower disk-like plate, said protrusion of said lower disk-like plate is provided at a position on said circle and is adapted for being elastically pressed; thereby when said upper and lower disk-like plates are assembled with each other and rotated relatively to each other, and when said protrusion arrives at a position of one of said two dents, said protrusion and said one dent engage with each other, then a force is exerted to rotate said upper disk-like plate to cause said protrusion to move downwardly against an elastic force to disengage from said one dent; after rotating for 180 degrees, said protrusion arrives at a position of the other of said two dents to engage therewith.

* * * * *